United States Patent [19]

Richards

[11] Patent Number: 4,485,664

[45] Date of Patent: Dec. 4, 1984

[54] DEVICE FOR FORMING AND BENDING METAL

[75] Inventor: Robert E. Richards, Kalamazoo, Mich.

[73] Assignee: J. A. Richards Company, Kalamazoo, Mich.

[21] Appl. No.: 419,977

[22] Filed: Sep. 20, 1982

[51] Int. Cl.[3] ..... B21D 9/05

[52] U.S. Cl. ..... 72/386; 72/389; 72/212; 83/574; 29/560

[58] Field of Search ..... 72/384, 386, 389, 442, 72/481, 158, 324, 212; 100/214; 29/401.1, 560; 83/574; 269/285

[56] References Cited

U.S. PATENT DOCUMENTS 2,614,605 10/1952 Senna ..... 72/158

3,678,724 7/1972 Stone et al. ..... 83/574

FOREIGN PATENT DOCUMENTS 727175 3/1955 United Kingdom ..... 72/212

*Primary Examiner*—Daniel C. Crane

*Assistant Examiner*—David B. Jones

*Attorney, Agent, or Firm*—Price, Heneveld, Huizenga & Cooper

[57] ABSTRACT

A metal forming tool having a reciprocal ram carrying tubular beam to which is attached a metal plate upon which workpiece holders are mounted, the tubular beam having a pivotal support to allow the tool to be pivoted between a vertical position in which the ram reciprocates vertically and a horizontal position in which the ram reciprocates horizontally. The workpiece holders are independently and detachably secured to the work platform by means located behind the workpiece holders on a line parallel to the line of movement of the ram, so that the tool performs both press and bending functions, and also workpieces with severe or multiple bends can be formed or straightened without excess obstruction by the securing means.

3 Claims, 5 Drawing Figures

DEVICE FOR FORMING AND BENDING METAL

BACKGROUND OF THE INVENTION

Bending devices for forming metal are well known and provide a variety of functions. One such type of device includes a sliding ram that reciprocates in a horizontal plane so as to advance the ram toward a set of workpiece holders. Such bending machines usually include a table-like work area on which are mounted the workpiece holders, the particular configuration of the workpiece holder being dictated by the type of bending the machine is to perform and the construction of the table supporting the weight of the workpiece during bending. The ram has a workpiece engaging element which is also configured according to the dictates of the type of bending the machine is to perform. As the ram is advanced toward the workpiece holders, the workpiece is pinned between the engaging area of the ram and the workpiece holders, resulting in the desired bending of the workpiece. In other horizontal benders, the ram is stationarily mounted while the workpiece holders are slidably mounted on the machine, to advance toward the ram during operation of the bender. These bending devices commonly use a hydraulic system to reciprocate the sliding component.

A variety of means are known for mounting the workpiece holders on metal bending machines, with many machines having a bracket located above the workpieces which either joins the workpieces or extends out over the work area. During operation, the ram of such devices displaces the workpiece underneath such an overhanging bracket, so that in order to remove the workpiece from the unit, the ram must be withdrawn sufficiently to allow the workpiece to be withdrawn from underneath the bracket. In other machines having workpiece mounting brackets which are located to the side of the workpieces, the functionability of the machine is reduced by the obstruction of portions of the work area, which obstruction interferes with the forming of workpieces having multiple or severe bends.

Like horizontal bending machines, arbor presses are well known in the art. Such presses have a reciprocating ram which slides in a vertical plane in order to advance or retreat from the work area. Due to the vertical reciprocation of the ram, these presses typically are used for functions different from those of horizontal benders, vertical presses often being used to press bearings in or out, or equipped with a knife edge to operate as a press brake, while horizontal devices are used more often for pipe or other types of bending. These vertical presses also have workpiece holders mounted on the work area which are configured according to the dictates of the function provided by the machine. Common types of workpiece holders are brackets for holding long rods during bending, or a platform having an aperture therein for supporting a workpiece while a cylindrical ram presses bushings or bearings in or out, as well as being alternately equipped with the knife edge mentioned above.

SUMMARY OF THE INVENTION

The invention is a tool for forming metal which has a body member that includes a housing and a work area element secured intermediate the ends of the body member. The device has means for mounting workpiece holders on the work area element and a ram slidably mounted in the housing with a workpiece engaging element mounted thereon, so that the ram is reciprocated toward and away from the workpiece holders by suitable means. A pivotal mounting means mounts the body member to a support means, so that the body member is pivotable between a vertical position in which the ram reciprocates vertically and a horizontal position in which the ram reciprocates horizontally.

In more specific embodiments, the housing is a tubular beam which extends from both sides of its pivotal mounting means, one end of which is received in the pedestal base when the machine is in the vertical position, and two projections extend perpendicular to the work area element to provide support for a workpiece during operation in the vertical position. The workpiece holders are secured to the work area element independently by a bracket which extends backward from the holder in a line parallel to the line of advance of the ram, in order to leave the work area substantially free of obstructions.

Thus, this device provides a metal forming tool which can quickly be converted from a horizontal bending mode to a vertical press mode. The device is characterized by a substantial increase in versatility and cost effectiveness over present metal forming tools in that it replaces two such separate devices. Additionally, by providing a substantially unobstructed work area, workpieces having multiple or severe bends can be worked without interference by the workpiece holder mounting means. In order to remove the workpiece from the device after forming, the ram is only required to be backed off sufficiently to provide clearance from the actual engaging areas of the ram and workpiece holders, since the workpiece is not displaced under an overhanging bracket during the operation of the device.

DETAILED DESCRIPTION OF THE PREFERRED EMBODIMENT

Figure 1:
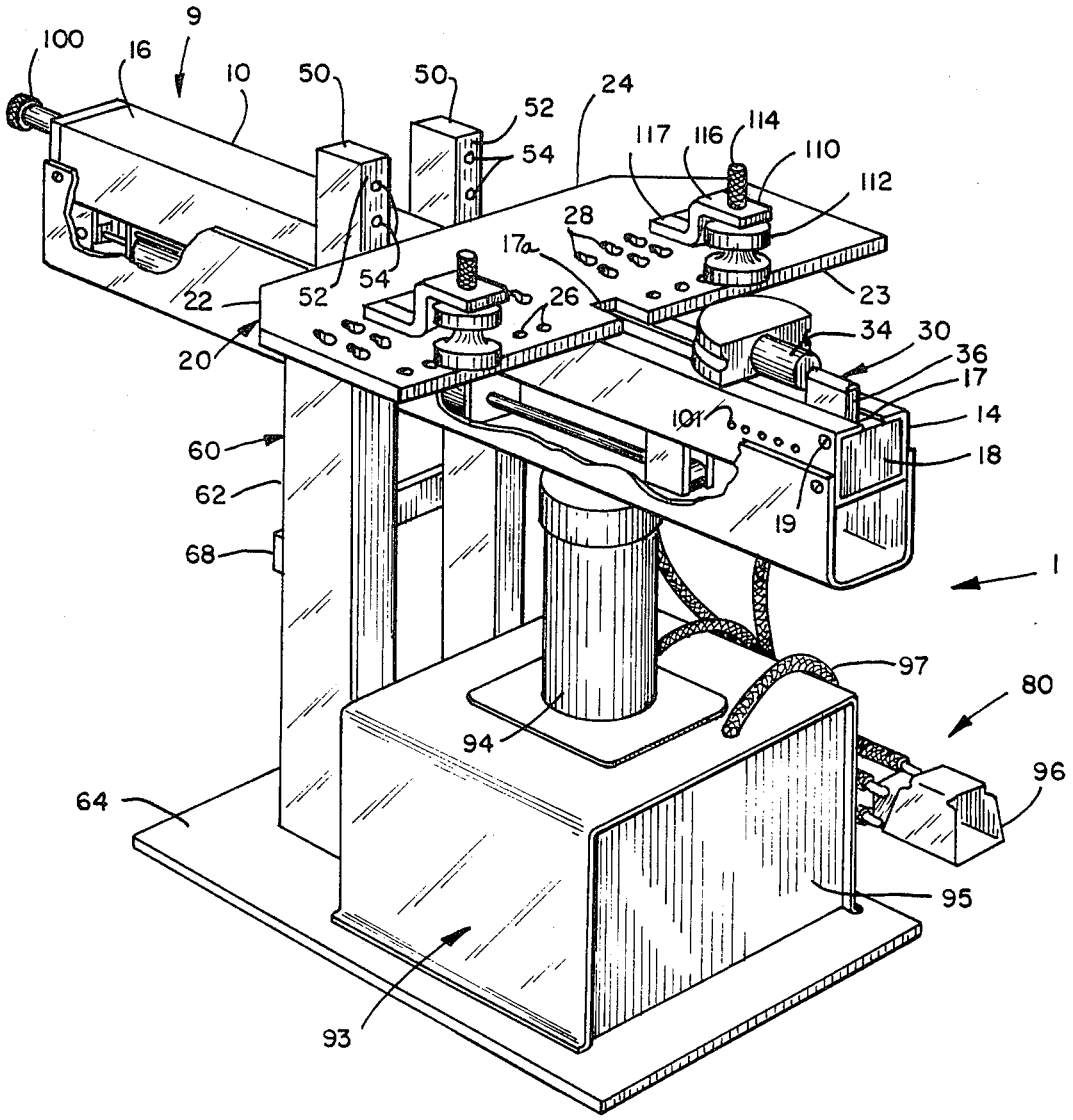
FIG. 1 is an oblique view of a metal forming tool of the present invention in the horizontal position.
Figure 2:
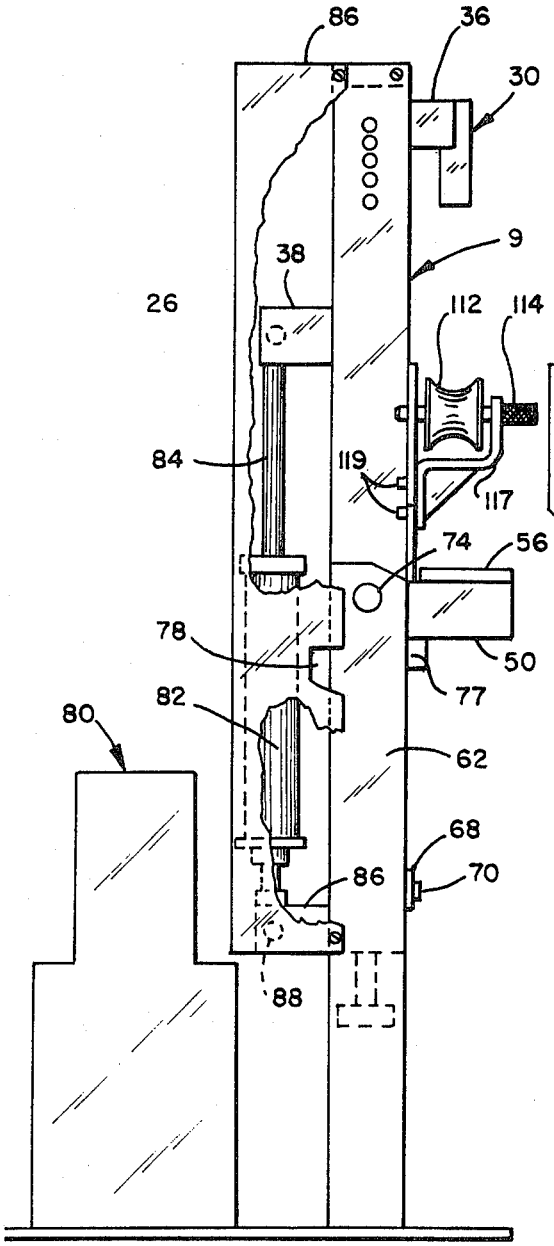
FIG. 2 is an oblique view of a metal forming tool of the present invention in the vertical position.

Numeral 1 refers generally to a tool for forming metal embodying the present invention. Metal forming tool 1 is depicted in FIG. 1 in the horizontal position, for use in bending tube, rod, bar stock and the like. Metal forming tool 1 is depicted in FIG. 2 in the vertical position for use as a press, such as an arbor press, press brake or the like. The unit 1 is pivotal between these two positions to perform a variety of metal forming functions.

Figure 3:
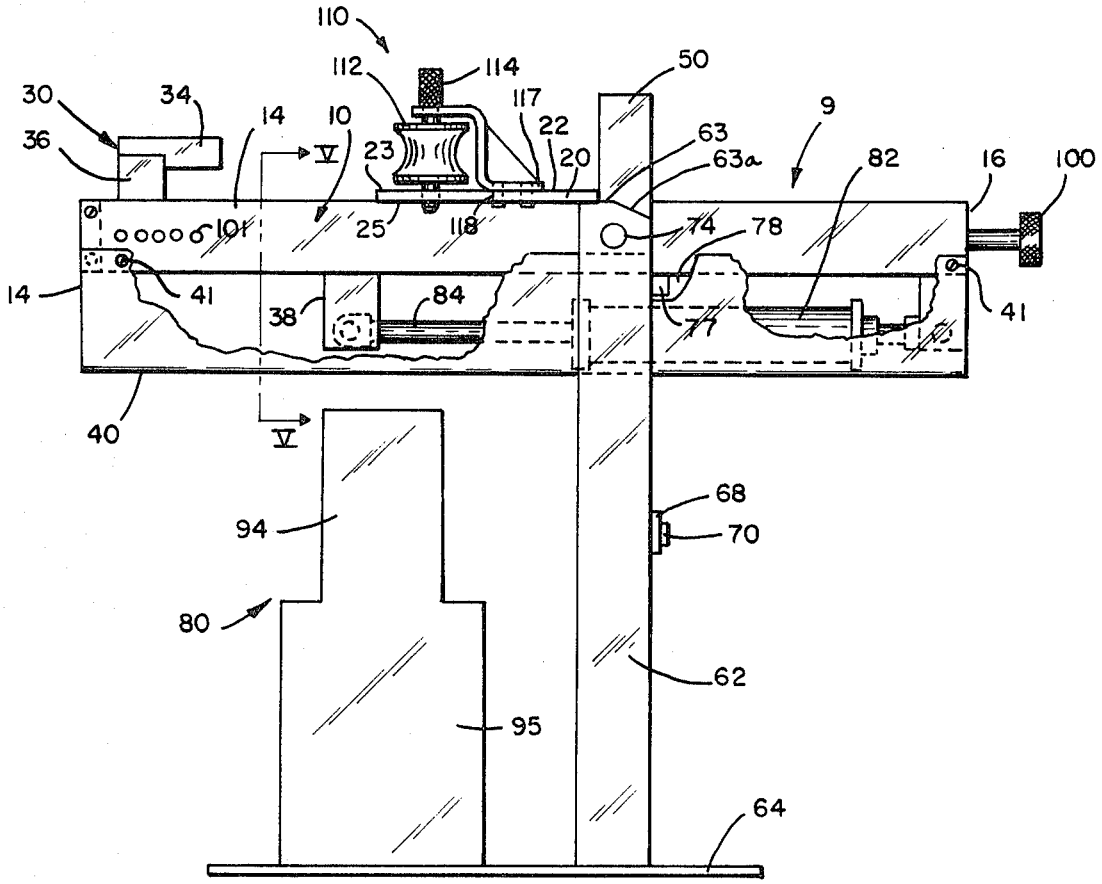
FIG. 3 is a side elevational view of the device of FIG. 1 in the horizontal position.

Metal forming tool 1 includes a body member 9 having a housing 10 to which is secured a work area element or platform 20. As shown in FIGS. 1–6, housing 10 is a tubular beam of rectangular cross section. Beam 10 has two ends 14 and 16, end 14 being the working end and end 16 being the locking end, as shown in FIGS. 1 and 3. The side of the beam forming the top in horizontal mode at the working end is provided with a slot 17. The beam 10 intermediate ends 14 and 16 is pivotally supported on a pedestal 60. The beam 10 is pivotally connected to pedestal 60 by pivot pin 74, permitting body member 9 to pivot between the vertical and horizontal positions (FIGS. 2 and 3). The end 14 of the beam is closed by a plate 18 secured by bolts 19. This arrangement holds the sides of the beam from spreading.

Work platform 20 is a flat plate 22 welded to the face of the beam 10 forming the beam's top when in the horizontal position. Plate 22 projects from the sides of beam 10 sufficiently to provide a stable support of sufficient area for a workpiece while tool 1 is in operation, with plate 22 supporting the weight of the workpiece. Plate 22 has three parallel rows of apertures therein to be used in holding the workpiece on work area 20, with one row being circular apertures 26 near the leading edge 23 of plate 22. Spaced further from leading edge 23 are two adjacent rows of apertures 28, each of which is elongated and has a keyhole shape. The number and spacial arrangement of the apertures will depend upon the various uses to which the tool is to be put.

Figure 5:
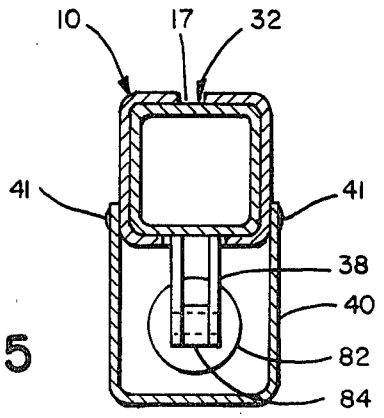
FIG. 5 is a sectional view taken along line V—V of FIG. 3 of the tubular beam and slider.

Ram 30 is slidably mounted in beam 12. Ram 30 includes sliding tube 32 of a cross-sectional dimension to be slidably and telescopically received in tubular beam 10 (FIG. 5). A flange 36 is secured to the tube 32 and extends through slot 17 on the top of beam 10. Slot 17 extends to and partially under plate 22, which is also equipped with an aligned short slot section 17*a* (FIG. 1). Workpiece engaging element 34 is secured to the free end of connecting flange 36 and is positioned to pass over the top of plate 22. Depending from the other end of tube 32 is hydraulic connecting flange 38, shown in FIG. 3. Hydraulic connecting flange 38 projects through a slot on the underside of beam 10. Secured to the sides of the beam and depending from it is a trough like shield 40. The shield 40 is secured to the beam by suitable means such as the screws 41.

Figure 4:
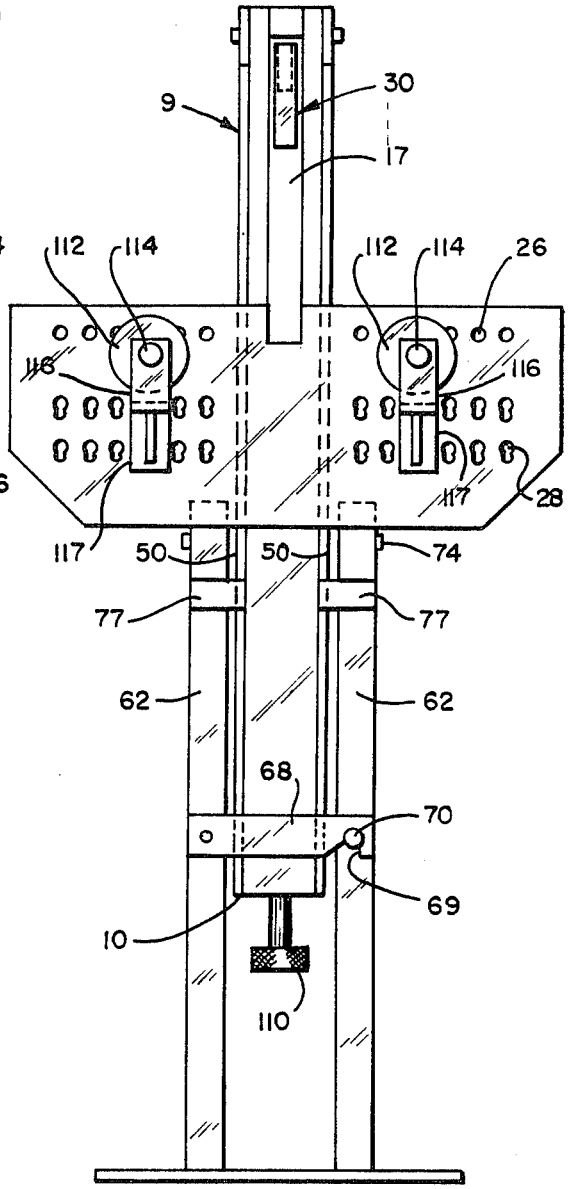
FIG. 4 is a rear end elevational view of the device of FIGS. 1 and 3.

A pair of support stops 50 are rigidly secured one to each side of the beam 10 and project upward at the trailing edge 24 of plate 22 (FIGS. 3 and 4). The support stops may have one or more apertures 54 for securing suitable workpiece supports 56 when the tool is in arbor press mode. Support stops 50 can also be used as a backstop for certain workpiece holders while in the horizontal position.

Pedestal 60 has two spaced, rectangular legs 62 extending upward from base 64. Legs 62 are spaced sufficiently to receive beam 10, including the shield 40, and support stops 50 between them (FIG. 2). Pivot pin 74 passes through legs 62, support stops 50 and beam 10 to pivotally mount beam 10 to pedestal 60. Legs 62 have flattened tops 63 and chamfered corners 63*a* to allow plate 22 to pivot past tops 63 (FIG. 3). Legs 62, at their bottoms, are rigidly joined to a base. On one face of the legs, latch bar 68 is pivotally bolted to one leg and has a notch 69 at the opposite end to engage the keeper bolt 70 on the opposite leg (FIGS. 3 and 4). A pair of stop-blocks 77 are provided one on each leg 62 (FIGS. 2, 3 and 4). These are secured to the legs facing the beam end 16 and in a vertical position to provide a rest for the rear edge of the support stops 50 when the beam is pivoted to vertical position. To provide clearance for these stops, as the beam is pivoted, the shield 40 is notched at 78 (FIG. 2).

Hydraulic system 80 activates ram 30 and is of standard hydraulic design. Cylinder 82 having piston 84 therein is mounted on the underside of beam 10 within the shield 40, as shown in FIGS. 1, 2 and 3. Mounting bracket 86 is secured to end 16 of beam 10 and project downwardly. By means of pin 88 it supports one end of cylinder 82. Piston 84 is pivotally connected to flange 38 by suitable means such as pin 92. The hydraulic drive unit 93 includes pump 94 and fluid reservoir 95. A foot valve 96 is connected by hydraulic lines 97 to the reservoir, pump 94 and cylinder 82 to control operation of the piston 84.

Adjustment screw 100 is used to limit the work stroke of ram 30. Rotation of screw 100 shifts a stop within beam 10 to reposition the limit of travel of ram 30 toward end 16 of the beam. Such stops and their construction are conventional and further description is not considered necessary. Additional stops are provided to limit the return stroke of the ram. This is accomplished by providing a number of spaced holes 101 at the end 14. By insertion of a suitable pin extending entirely through the beam in one of the holes, a stop is created.

Workpiece holders 110 include pivot blocks 112 which can be of various shapes and sizes, as dictated by the shape of the workpiece and the type of bend it is desired to produce. As shown in the drawings, pivot blocks 112 are cylindrical and have an annular groove of standard design for use in pipe bending. Each pivot block 112 is secured to plate 22 with a removable pin 114 passing through bracket 116, the pivot block and into one of the holes 26. Bracket 116 is secured to the plate 22 by a pair of pegs 118 seated in openings 28 (FIG. 3). The free end of each peg has a rearwardly extending tab 119 of a shape to pass through apertures 28. When pegs have passed through enlarged portions of the apertures 28 and the bracket and pegs shifted slightly rearwardly, tabs 119 hook under plate 22 and prevent inadvertent removal of bracket 116. Pin 114 can then be installed to both secure the pivot block and prevent bracket 116 from sliding forward, thereby locking bracket 116 to plate 22. Preferably, no support or connecting means extends laterally of the pivot blocks 110. As each pivot block 110 is independently secured to plate 22, the work area between the pivot blocks is free of overlying obstruction.

Carried on connecting flange 36 of ram 30 is a configured workpiece engaging die 34. The precise configuration of the die 34 is dictated by the type of function to be performed and the shape and character of the workpiece.

While in the horizontal position, the underside 25 of a plate 22 seats on the flat portion of top 63 of leg 62 (FIG. 3). Top 63 of leg 62 and pivot pin 74 together with the stop 77 support body member 9 and plate 22, preventing the body member 9 from pivoting counterclockwise from the position illustrated in FIG. 3.

To convert the unit 1 from a horizontal position to the vertical position, shown in FIGS. 2 and 4, lock bar 68 is rotated upward and beam 10 is pivoted until end 16 is received within the space between legs 62 and the stop supports 50 rest on the stop blocks 77. Beam 10 is contained within the space between legs 62, enabling lock bar 68 to be rotated until notch 70 passes over bolt 72, thereby securely latching end 16 of beam 10 to pedestal 60. The beam, in vertical position, is positively locked between the stop blocks 77 and the bar 68. Since the back corner of top 63 on leg 62 is chamfered, tops 63 do not interfere with plate 22 as beam 10 is being pivoted. To return unit 1 from a vertical to a horizontal position, the reverse of the above steps are followed.

The construction of the beam is such that its weight biases it to remain horizontal when in that position. However, the location of the cylinder at the rear end 16 of the beam acts as a partial counterbalance making it possible for one operator to pivot the beam to and from vertical position. This materially increases the utility of the machine. The provision of the cover 40 protects personnel while the machine is in operation in both operating positions.

In use, foot valve 96 activates cylinder 82, causing piston 84 to be either extended or retracted. When activated, piston 84 reciprocates ram 30, either advancing the die 34 toward the workpiece held between pivot blocks 110 or retracting die 34 to free the workpiece. Since slots 17 and 17*a* extend into plate 22, connecting flange 36 can be advanced along beam 10 sufficiently to pass die 34 over plate 22 almost to the support stops 50.

When in the vertical position, ram 30 advances downward toward pedestal 60 and support stops 50. A workpiece support 56 can be mounted on support stops 50 to support a workpiece during vertical operation (FIG. 2). In the alternative, brackets 116 with or without pins 114 or pivot blocks 112 can be secured to plate 22 to serve as workpiece holders 110, as shown in FIG. 4. Since the narrow ends of the holes 28 extend downwardly when unit 1 is in a vertical position, the brackets 116 are biased into locked position on the platform, and inadvertent release from platform 20 is prevented.

Alternative uses for unit 1 in the vertical position include use as a press brake, having a die such as a V-die supported on projections 50 and a press brake mating die carried on ram 30. The unit can also be used as an arbor press to pressfit or remove bushings, bearings and the like with a cylindrical rod attached to connecting flange 36, a suitable opening can be provided through the support 56 to align with the gap between workpiece supports 50 allowing discharge of a bushing or the like.

While in use in the horizontal position, if two cylindrical pivot blocks are connected to plate 22 and a curved element is attached to connecting flange 36, the unit can be used as a pipe or U-bolt bender, with ram 30 advancing toward pedestal 60. In the alternative, if a V-shaped workpiece holder is connected to projections 50 and a dovetailed angle is attached to connecting flange 36, the unit can be used for bending flat stock. The invention is particularly useful for small shops, tool rooms and operations where a wide variety of operations are needed. In these circumstances, the tool materially reduces initial investment costs. It is also conserving of space, a very important factor in many situations. Its simplicity significantly reduces changeover time and labor costs.

Certain changes or modifications can be made in the embodiment of the above description and drawings without departing from the principle and concept of the invention. It is to be understood that such changes are to be considered as included in the hereinafter appended claims unless these claims, by their language, expressly state otherwise.

The embodiments of the invention in which an exclusive property or privilege is claimed are defined as follows:

1. A tool for forming metal including an elongated body member and a pedestal; means pivotally securing said body member intermediate its ends to the top of said pedestal; a workpiece support mounted to said body member adjacent said pivot means; a ram mounted on said body member having means projecting through one side of said body member adjacent one end thereof; fluid powered means secured to said ram for reciprocating said ram lengthwise of said body member toward and away from said workpiece support; said body member being pivotable about said pivot means between a horizontal position wherein said ram and support extend above the top of said body member and said ram reciprocates horizontally and a vertical position wherein said ram operates vertically; said pedestal being bifurcated including a base and a pair of vertical legs extending upwardly therefrom and defining a central opening therebetween extending through the top thereof, said opening being of a length and width to receive the portion of said body member between said pivot means and the other end when said body member is in said vertical position; locking means for securing said other end of said body member directly to at least one of said legs of said pedestal when said body member is in said vertical position.

2. A tool for forming metal including an elongated body member and a pedestal; means pivotally securing said body member intermediate its ends to the top of said pedestal; a workpiece support mounted to said body member adjacent said pivot means; a ram mounted on said body member having means projecting through one side of said body member adjacent one end thereof; fluid powered means secured to said ram for reciprocating said ram lengthwise of said body member toward and away from said workpiece support; said body member being pivotable about said pivot means between a horizontal position wherein said ram and support extend above the top of said body member and said ram reciprocates horizontally and a vertical position wherein said ram operates vertically; said support seating on the top of said pedestal when said body member is in said horizontal position; the greater portion of the weight of said body member being in the portion between said pivot means and said one end to bias said body member to remain horizontal when in that position with said support seated on said pedestal; locking means for securing said body member to said pedestal when it is in its vertical position; said pedestal being bifurcated and having a central channel opening through the top thereof of a length and width to receive the other end of said body member when said body member is in said vertical position.

3. A tool for forming metal including an elongated body member and a pedestal; means pivotally securing said body member intermediate its ends to the top of said pedestal; a workpiece support mounted to said body member adjacent said pivot means; a ram mounted on said body member having means projecting through one side of said body member adjacent one end thereof; fluid powered means secured to said ram for reciprocating said ram lengthwise of said body member toward and away from said workpiece support, said fluid powered means including an operating cylinder mounted in the other end of said body member remote from said one end through which said projecting means extends; said body member being pivotable about said pivot means between a horizontal position wherein said ram and support extend above the top of said body member and said ram reciprocates horizontally and a vertical position wherein said ram operates vertically; locking means for securing said body member to said pedestal when it is in its vertical position; said pedestal being bifurcated and having a central channel opening through the top thereof of a length and width to receive the other end of said body member when said body member is in said vertical position.

* * * * *